United States Patent [19]

Shea

[11] 4,263,778

[45] Apr. 28, 1981

[54] STABILIZED STRETCH YARNS FOR STRETCH WOVENS

[75] Inventor: Robert J. Shea, Shelby, N.C.

[73] Assignee: Fiber Industries, Inc., Charlotte, N.C.

[21] Appl. No.: 915,093

[22] Filed: Jun. 13, 1978

[51] Int. Cl.[3] ..... D02G 1/02; D01H 7/92; D01H 13/28

[52] U.S. Cl. ..... 57/290

[58] Field of Search ..... 57/157 TS, 140 R, 287, 57/289, 290

[56] References Cited

U.S. PATENT DOCUMENTS

| | | | |
|---|---|---|---|
| 3,543,505 | 12/1970 | Stutz | 57/290 X |
| 3,791,121 | 2/1974 | Ernst | 57/287 |
| 3,796,036 | 3/1974 | Parker | 57/290 X |
| 3,874,159 | 4/1975 | MacFarlane | 57/157 TS |
| 3,936,999 | 2/1976 | Ikeda et al. | 57/290 |
| 3,956,878 | 5/1976 | Schaffer et al. | 57/157 TS |
| 4,086,751 | 5/1978 | Hino et al. | 57/157 TS |

*Primary Examiner*—Donald Watkins
*Attorney, Agent, or Firm*—Herbert M. Adrian, Jr.

[57] ABSTRACT

Stabilized stretch yarns of intermediate skein shrinkage and low torque which may be beamed without twisting are produced by draw texturing and stabilizing with little or no relaxation, preferably at relatively low temperatures. These yarns may be converted to wovens with adequate comfort stretch.

12 Claims, 2 Drawing Figures

STABILIZED STRETCH YARNS FOR STRETCH WOVENS

This invention relates to the production of textured yarns and, more particularly to stabilized stretch polyester yarns for special utilization in stretch wovens.

The production of textured yarns of varying bulk, twist, torque and shrinkage, among other characteristics by false twist texturing methods through one or more heat treatment stages as practiced for example by throwsters are well-known. U.S. Pat. Nos. 2,803,109; 3,077,724; 3,091,912; 3,404,522; 3,422,617; and 3,472,011, are of interest. Later advances in the technology have led to improved draw texturing methods for the provision of such yarns, as disclosed for example in representative U.S. Pat. Nos. 3,977,212; 3,955,351; 3,956,878; 4,012,896; 4,028,875 and 4,068,460; and as practiced by yarn producers. Modification in textured yarn characteristics by post texturing treatments such as muff or package dyeing, the methods disclosed in U.S. Pat. Nos. 3,316,705; 3,618,184; 3,462,933 or 4,016,715; or controlled fabric finishing steps, are also well-known.

Such yarns may be adapted for use in a variety of fabric constructions including knits and wovens.

Stretch wovens for example typically afford a fabric comfort stretch of about 15% in warp and filling, as provided by a throwster textured single heater yarn having about 30% skein shrinkage. Such yarn cannot be beamed for use as a warp yarn without twisting, as it contains excessive torque levels. Thus, high torque yarns tend to snarl between the cone and tensioning device in the creel and when the warper is started, any tightly bound snarls will not pull out and appear as imperfections in the woven fabric. Also, the abrasive action of the heddles and reed on the loom cause broken filaments during weaving.

Single heater or so-called stretch "S" and "Z" textured yarns may be plied or compacted in balanced configurations to reduce torque, or the yarn may be subjected to a further heat treatment under controlled conditions of shrinkage, as in a double heater texturing operation, to produce so-called "set" yarns.

However, under current finishing procedures utilizing boil-off in the dyeing stage, an undesirable fabric characteristic, "cracking" (a defect consisting of an open filling wise streak extending across the fabric) is developed with double heater yarn in this use, hence stretch yarn is typically employed, as aforesaid, having up to 40% or more skein shrinkage.

"Partially set" yarns have been offered having intermediate stretch, bulk or torque characteristics including those adapted to provide, at lower relax, higher fabric bulk and lower skein shrinkage but without entirely satisfying market requirements.

It has accordingly been an objective to produce a textured yarn for competitive use in stretch wovens offering intermediate skein shrinkages and low torque to permit beaming.

BRIEF DESCRIPTION OF THE INVENTION

It has now been discovered that a stabilized stretch yarn of low torque having the required characteristics as aforesaid can be produced by draw-texturing a polyester yarn with second stage heat treatment under a condition of low to essentially no relaxation and relatively low temperatures. In this manner, polyethylene terephthalate 150/36 yarns have been produced, at torque levels permitting beaming, and skein shrinkages of 20–25% with equivalent fabric stretch (15% comfort stretch) in both warp and filling as stretch yarn with much higher shrinkages, e.g., up to 46%. In addition, increased fabric yield is achieved as a consequence of the development of such fabric stretch in the filling at a wider finished width. Processing is also improved as a consequence of the low torque levels secured.

Thus, in accordance with the present invention, a polyester yarn is draw textured under conventional conditions and thereafter subjected on the run to a further heat treatment under conditions of low to essentially no relaxation i.e., 0% to below 5% relax, at relatively low temperatures of above 150° C. e.g., 170° C. to about 210° C.

Boucle yarns have classically been produced with conditions of underfeed through the second heat treatment stage, but produce low stretch yarns characterized by a high snarl content, as for use in toweling.

Adequate skein shrinkage and resultant comfort stretch in wovens may also be achieved under high relax conditions of 25% or more; but such yarns evidence an unacceptable level of liveliness.

DETAILED DESCRIPTION OF THE INVENTION

In the preferred form of the present invention spun polyethylene terephthalate yarn is draw textured to a 150/36 stretch yarn and subjected to a second heat treatment under conditions of 0% relax, 170° C., and woven in warp or filling in e.g., a twill weave to provide a fabric stretch of at least 15%.

The invention will be more fully described by reference to the accompanying drawings in which.

Figure 1:
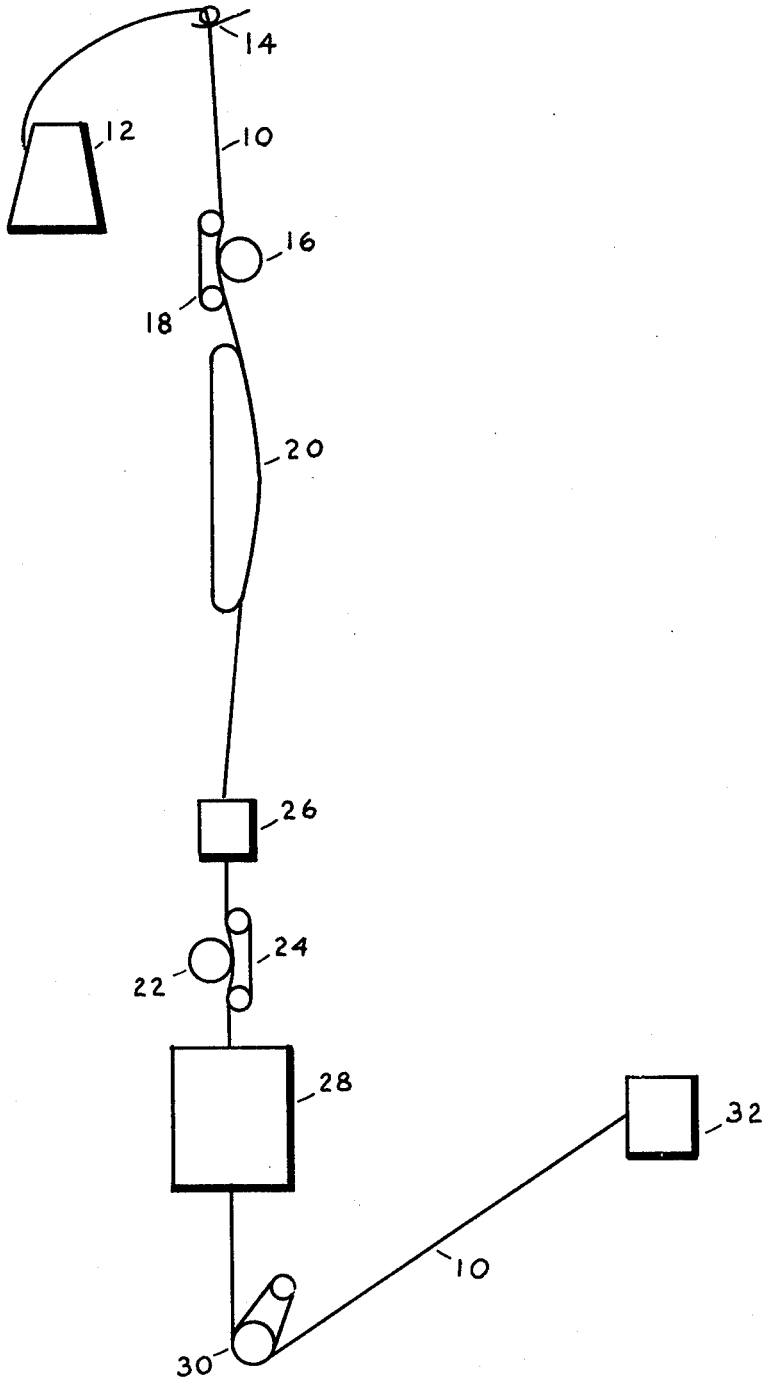
FIG. 1 is a partial schematic representation of a typical arrangement for practising the present invention.

Referring more particularly to FIG. 1, a preferred embodiment of the present invention is illustrated wherein flat yarn 10 is withdrawn from a yarn supply 12 across yarn guides 14 to feed roll 16 in contact with nip means 18. Yarn from feed roll 16 passes in contact with heater zone 20, which is preferably a heated plate. A drawing tension is applied by means of draw roll 22 in contact with nip means 24. This drawing tension is passed through twisting means 26 and back along the yarn to heater zone 20 wherein it is dissipated in drawing of the yarn which takes place on the heater plate or within the heater zone.

Twisting means 26 inserts twist into the yarn which again backs up the yarn into heater zone 20 wherein it is heat set in the twisted configuration during drawing of the yarn in the heater zone.

Heater zone 20, as noted above, is preferably a heated plate but could be a hot pin, heated rolls, steam chamber, hot air oven or the like heating means which are capable of heating the yarn above the second order transition temperature and preferably to 180° to 250° centigrade. The heating zone per se can and often is at a temperature greatly in excess of the temperature which the yarn actually attains. Such heater temperatures can be well in excess of the yarn melting temperature, with the speed of the yarn being sufficiently high to prevent melting of the yarn.

Twisting means 26 can be any of the numerous known twisting devices which are capable of inserting the desired degree of twist into the yarn.

The amount of twist put into the yarn is dependent on the yarn denier and the desired amount of bulk. Thus, for low denier and monofilament yarn, higher twist levels are normally used while for higher deniers, lower twist levels are required for desirable bulk. The most desirable twist level ranges for various yarns can be expressed by the equation:

$$\sqrt{\frac{480}{\text{denier}}} \text{ to } \sqrt{\frac{1000}{\text{denier}}} = TPI$$

Yarn passing out of twist means 26 is untwisted as it travels to draw roll 22 and nip roll 24 and is cooled and set over this distance or by the provision of cooling means (not shown). Second heating means 28 is employed to stabilize the bulk and torsional forces in the yarn. Like the first such heating means, it may comprise a heated plate etc. but is preferentially constituted by a elongated hot box to maximize heat transfer efficiency and contact time without abrasive frictional forces or attendant geometric constraints being applied to the yarn, i.e., the yarn is freely running through the heat treatment zone. The heat treatment temperature may range from above 150° C. to 210° C., preferably 170°–190° C., for hot box apparatus, with appropriate correlative adjustment for hot plate or other heating means.

The yarn is conducted through the second heater under conditions of little or no relaxation, established by the relative speed of draw roll 22 and nip roll 24 and take-up roll 30 which are in accordance with this invention preferably essentially the same. The yarn tension accordingly will reflect essentially the degree of shrinkage induced at the applicable treatment temperature. From take-up roll 30, the yarn may be packaged onto bobbins or packages 32.

Texturing conditions in the first stage may range without limitation over those typically employed in the preparation of textured polyester yarns and known to those skilled in the art. Preferably, the principal draw texturing stage is conducted in accordance with the teachings of U.S. Pat. No. 3,956,878 of Schaefer et al., incorporated herein by reference.

Preferably, draw textured feed yarn is supplied on the run to the second stage, although equivalent lagged yarn may also be employed. Spindle textured yarn is principally exemplified, but it will be understood that friction twisted yarn is likewise applicable.

Figure 2:
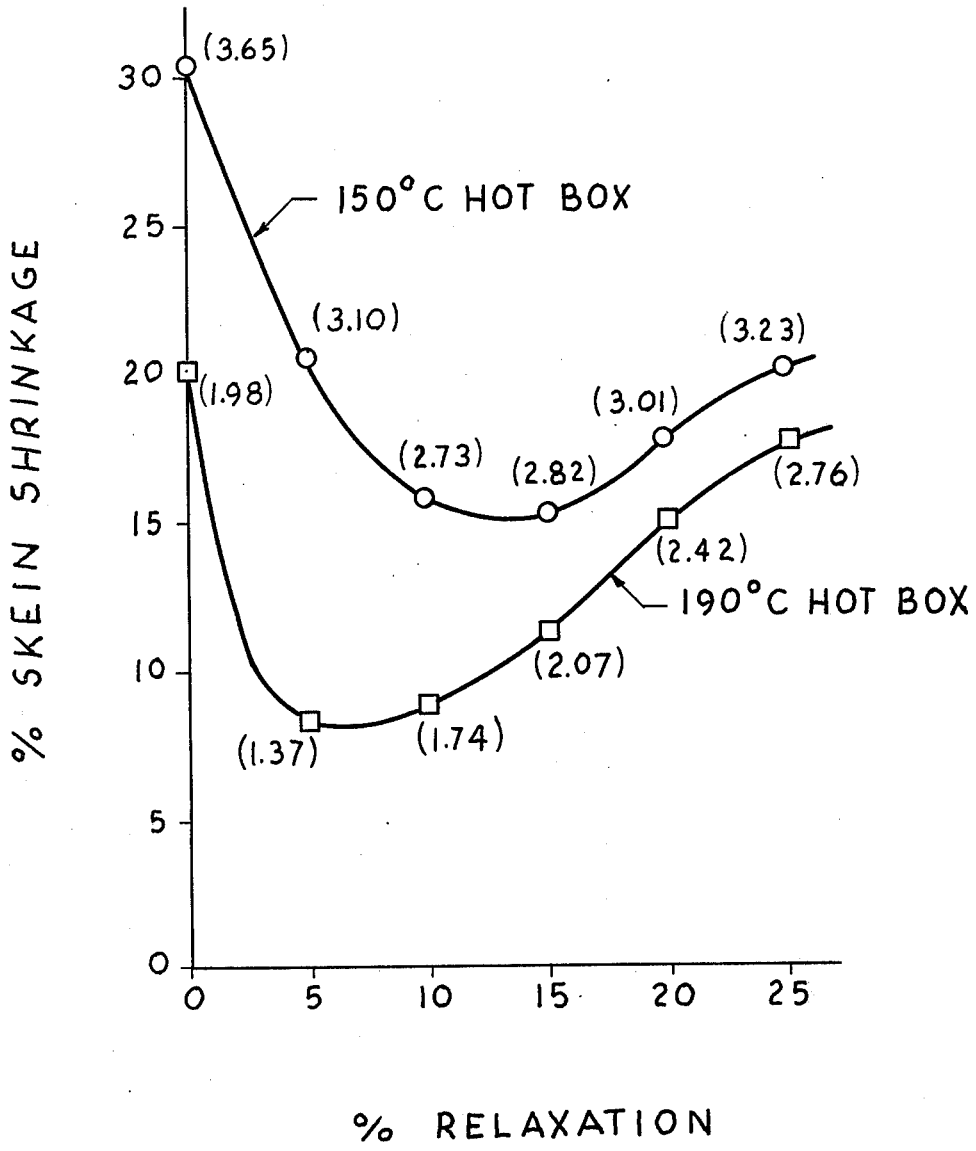
FIG. 2 is a graph demonstrating the effect of varying amount of relax of second stage heat treatment and temperature in the second stage heat treatment (hot box) on skein shrinkage and yarn liveliness.

Referring then, to FIG. 2, skein shrinkage and yarn liveliness (values in parentheses) are plotted versus yarn stabilization conditions in the second stage namely, for various percentage relaxation values at 150° and 190° C. hot box, respectively. FIG. 2 demonstrates that skein shrinkage and yarn liveliness go through a minimum value as percentage relax increases from 0 to 25%. Skein shrinkage and torque decrease as hot box temperature increases.

Yarns produced in accordance with the present invention exhibit a skein shrinkage of 10–30%, a yarn liveliness of less than about 2.5 in. preferably 2.2 to 2.5 in. and in a twill weave, a fabric stretch of at least 15%. Best results have been secured at treatment temperatures, e.g., 170° C. hot box.

The polyester yarns are representatively exemplified herein by polyethylene terephthalate but any synthetic linear fiber-forming polyester yarn may be similarly handled, although polymers composed of at least 85% by weight of an ester of a substituted aromatic carboxylic acid are preferred. Such yarns may also contain modifiers which affect the chemical and physical properties of the fiber. Copolymers of polyethylene terephthalate with isophthalic acid, sulfo-isophthalate acid, propylene glycol, butylene glycol and the like are contemplated.

The yarn prepared in accordance with the invention may, of course, be plied, compacted, interlaced or combined regularly or intermittently with one or more ends of other, or differentially colored, dyed or textured yarn ends, to create special effects in the end use, and may comprise warp or filling in a woven construction, or even be specially adapted for knitting or other interwoven use. The selection of yarn denier will depend upon intended use, but may range over the whole textile range e.g., 50 to 520 denier.

In the following Examples, the terms denier, tenacity and elongation are employed in the usual and customary sense. "Yarn liveliness", as a measure of the tendency of a yarn to kink or twist upon itself in a relaxed state due to inherent torque, is tested by conditioning yarn samples to moisture equilibrium at 65% RH, 70° F., attaching the yarn between a movable and a stationary clamp (10′ gage) in an untensioned state, placing a tension hook (0.110 gms) on the yarn at a point midway between the two clamps, setting the yarn parallel with a rule edge by adjusting slack between the clamps, moving one clamp toward the other until the yarn twists or kinks upon itself, measuring, recording and expressing to a hundredth of an inch the point at which yarn twist first appears, and repeating the above determination ten times, reporting the average, in S or Z direction.

Skein shrinkage properties were determined by winding yarn into skeins of 12,000 total denier on a reel, using a winding tension of 8 to 10 grams. The number of yarn wraps on the reel is in accordance with the equation:

$$\text{yarn denier } D = \frac{6000}{\text{number of wraps } (R)}$$

The yarn is then removed from the reel in a loop configuration with each side of the loop equalling 6000 denier, thereby providing a skein of 12,000 denier. A 20 gram weight is hung on the skein, the length of the skein measured and the weighted skein suspended in water at 82.2° centigrade +2.8° centigrade for b 12 minutes. The skein is removed from the water, lagged for 10 minutes to dry and then the length of the skein is remeasured with a suspended 20 gram weight attached. The skein shrinkage is then calculated according to the formula:

$$\frac{Lo - Lf}{Lo} \times 100 = \% \text{ Skein Shrinkage}$$

wherein Lo equals the original length of the skein and Lf equals the final length of the skein.

The skein shrinkage test described includes both the effects of bulk or crimp development and linear shrinkage. The yarn linear shrinkage can be determined by a test well-known in the art.

Fabric or comfort stretch (the stretch the fabric could be expected to yield during wear) was approximated by a standard Instron stretch test on a 10 inch by 2 inch piece of fabric (2×2 twill weave with conventional set yarn in the yarn wrap) at 4 pounds load in the filling direction (strain rate 120%/min.).

EXAMPLE I

Continuous filament 36 filament polyethylene terephthalate yarn was spun from 0.67 I.V. polymer at a spinning temperature of 285° C. and taken up at 4650 fpm. The produced yarn was then draw-textured using Barmag draw-texturing machines equipped with spindle twisters, under the following conditions:

| | | |
|---|---|---|
| TPI | 70 | 65 |
| Primary Heater | 230 | 225 |
| Draw Speed | 438 | 478 |
| % Relax | 0 | 0 |
| Hot Box | 170 | 170 |

The textured yarn exhibited the following characteristics:

| | | |
|---|---|---|
| Denier | 154 | 153 |
| Tenacity | 3.2 | 3.7 |
| Elongation | 15 | 18 |
| Skein Shrink. | 25 | 23 |
| Yarn Liveliness (in.) | 2.45 | 2.38 |

and was successfully slashed and woven without added twist or compaction (interlacing) to provide a fabric having a comfort stretch in warp and filling exceeding 15%.

EXAMPLE II

Modified conditions in the texturing of the same yarn utilized in Example I were employed in the following runs:

Comparison of Textured Filling Yarns for Stretch Wovens

| Sample | A | B | C | D | E | F | G |
|---|---|---|---|---|---|---|---|
| TPI | 65 | 65 | 65 | 72 | 72 | 72 | 50 |
| Primary Heater | 220 | 220 | 220 | 245 | 245 | 245 | 245 |
| Draw Speed | 500 | 500 | 500 | 500 | 500 | 500 | 500 |
| % Relax | 25 | 0 | 10 | 0 | 16 | 0 | 25 |
| Hot Box | 230 | 230 | 150 | OFF | 190 | 190 | 170 |
| % Skein Shrinkage | 6.7 | 11.9 | 18.0 | 45.9 | 10.8 | 22.3 | 22.6 |
| Yarn Liveliness (in.) | .91 | 1.19 | 2.90 | 3.95 | 1.67 | 2.07 | 2.69 |
| Finished Width (in.) | 40.75 | 36.25 | 38 | 34.75 | 38 | 34 | 35.25 |
| % Fabric Stretch | 5 | 8 | 8 | 15 | 10 | 18 | 17 |

The above results show the desirability of relatively low temperature, low or no relax conditions in the second stage to provide a yarn of acceptable (≧15%) fabric stretch and yarn liveliness (2.5 in.). Thus, at second heater (hot box) temperatures of 230° C., 25% relax (run A), fabric stretch was insufficient; at high (25%) relax (run G) a satisfactory level of fabric stretch was achieved only in conjunction with unacceptably high yarn liveliness; 0% relax at high (230° C.) hot box temperature (run B) produced low fabric stretch; at intermediate relax of 10–16% (runs C and E) either fabric stretch was insufficient or yarn liveliness excessive or both; and while acceptable fabric stretch could be achieved without second stage heat treatment at 0% relax (run D), yarn liveliness was excessive.

Only the run (F) utilizing 0% relax, 190° C. hot box was successful in providing a stretch woven of suitable characteristics when stretch woven as filling in a 2×2" twill with a draw textured single heater warp.

In general, it has been determined that skein shrinkage values of 10 to 30% can be achieved with acceptable yarn liveliness over a range of second heater temperatures above 150 up to about 210° C. and relaxations of 0 to below 5%. As can be seen from the accompanying FIG. 2, the higher treatment temperatures are correlated with reduced relaxations, preferred results being secured in the range less than 5% relax, preferably 0% relax, and at lower temperatures, for higher skein shrinkage values.

It will be understood that while the present invention advantageously provides and is principally exemplified by a stabilized stretch yarn of equivalent denier to that stretch yarn supplied in ply twisted form, the teachings of the present invention are applicable to the preparation of yarn, e.g., 70 denier, in singles or doubled form.

I claim:

1. A process for the preparation of stabilized stretch polyester yarn comprising draw texturing polyester yarn of conventional specific gravity density at a draw-twist setting temperature of 220° to 245° C. followed by cooling and untwisting said yarn prior to conducting said yarn through a second heat treatment zone at a temperature of above 150° C. up to about 210° C., under essentially no relaxation and coordinating the temperature of the second heat treatment zone wherein the yarn is held under essentially no relaxation to the minimum effective temperature to thereby minimize the residual torque in said yarn.

2. The process of claim 1, wherein second heat treatment temperatures at the upper end of the temperature range are correlated with a relaxation close to zero to secure higher skein shrinkages and low torque.

3. The process of claim 1, wherein the draw textured yarn is freely run through a hot box maintained at temperatures of between about 170° and 190° C., at a relaxation of 0 to below 5%.

4. The process of claim 3, wherein said polyester is polyethylene terephthalate, and said relaxation is essentially 0%.

5. Stabilized stretch polyethylene terephthalate yarn having a skein shrinkage of 10 to 30%, and a yarn liveliness of less than 2.5 inches, produced by the process of claim 1.

6. The yarn of claim 5, having a skein shrinkage of 20 to 25% and exhibiting in a twill weave a fabric stretch in warp or filling of at least 15%.

7. A stretch woven comprising in warp or filling the yarn of claim 5.

8. A process according to claim 1 for the preparation of stabilized stretch polyester yarn comprising advancing polyester spun yarn through a false twist texturing zone at a rate to apply controlled drawing tension thereto, wherein the yarn is heated to its second order transition temperature, drawn, twisted, untwisted, cooled and set to form a false twist textured stretch yarn; and thereafter advancing said yarn at essentially the same rate through a heat stabilization zone and wherein it is subjected to a temperature of 150° to 210° C. to form a stabilized stretch false twist textured yarn.

9. In a method according to claim 1 for preparing stabilized stretch textured yarn comprising simultaneously false twist texturing and drawing polyester spun yarn through a texturing zone to draw rolls providing controlled drawing tension at a certain speed and thereafter conducting said yarn through a heat stabilization zone, the improvement which comprises conducting said yarn through the heat stabilization zone at essentially the speed of the draw rolls.

10. The method of claim 9 wherein the yarn is heated above its second order transition temperature, drawn, twisted, untwisted, cooled and set to form a stretch textured yarn in said texturing zone, and thereafter heat stabilized under essentially no relaxation at a temperature of above 150° C. up to about 210° C. to provide a stabilized stretch yarn.

11. The method of claim 10, wherein said yarn is polyethylene terephthalate, and said stabilized stretch yarn exhibits a skein shrinkage of 10 to 30%, and a yarn liveliness of 2.2 to 2.5 inches.

12. The method of claim 11, wherein said polyethylene terephthalate is heat stabilized in freely running condition in an enclosed zone maintained at a temperature of 170° to 190° C. and essentially 0% relaxation.

* * * * *